US007435110B2

(12) United States Patent
Xiao et al.

(10) Patent No.: US 7,435,110 B2
(45) Date of Patent: Oct. 14, 2008

(54) ELECTRICAL CONNECTOR WITH IMPROVED CONTACT ARRANGEMENT

(75) Inventors: Xue-Yuan Xiao, Kunshan (CN); Guo-Hua Zhang, Kunshan (CN); Jin-Kui Hu, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/786,117

(22) Filed: Apr. 10, 2007

(65) Prior Publication Data

US 2007/0238330 A1 Oct. 11, 2007

(51) Int. Cl.
*H01R 13/648* (2006.01)

(52) U.S. Cl. ..... 439/107

(58) Field of Classification Search ..... 439/108, 439/101, 607, 608, 79
See application file for complete search history.

(56) References Cited

U.S. PATENT DOCUMENTS 4,726,500 A * 2/1988 Rock ..... 225/96.5
5,238,414 A * 8/1993 Yaegashi et al. ..... 439/108
5,263,870 A * 11/1993 Billman et al. ..... 439/108
5,876,222 A * 3/1999 Gardner et al. ..... 439/79
6,241,556 B1 * 6/2001 Chih ..... 439/607
6,350,134 B1 * 2/2002 Fogg et al. ..... 439/79
6,767,224 B2 * 7/2004 Wu ..... 439/79
6,935,870 B2 8/2005 Kato
6,974,336 B2 12/2005 Shindo
7,077,668 B2 * 7/2006 Lapidot et al. ..... 439/108
2002/0123254 A1 * 9/2002 Kato et al. ..... 439/108

* cited by examiner

*Primary Examiner*—Alexander Gilman
(74) *Attorney, Agent, or Firm*—Wei Te Chung

(57) ABSTRACT

An electrical connector (100) has a first end for fitting with another connector and a second end for connecting to a board. The connector comprises an insulative housing (1), a number of contacts (2) and a metal shield (3) enclosing the insulative housing. The insulative housing includes a tongue plate (11) with a number of passageways (110) defined therein for receiving the contacts. The contacts are arranged side by side in the first end and arranged in three parallel rows in the second end. The contacts include signal contact pairs (21) and grounding contacts (22) disposed adjacent to and separating the signal contact pairs. Each signal contact pair includes a first signal contact and a second signal contact being substantially in equal length of the first signal contact. The signal contact pairs have matched impedance for transmitting high-speed signals, thereby canceling any cross talk therebetween.

20 Claims, 7 Drawing Sheets

ELECTRICAL CONNECTOR WITH IMPROVED CONTACT ARRANGEMENT

BACKGROUND OF THE INVENTION

1. Field of the Invention

This invention generally relates to an electrical connector, and more particularly to an electrical connector with improved contact arrangement to provide balanced signal transmission and low cross talk.

2. Description of the Prior Art

Electronic devices that operate, in part, to send electronic signals and to receive electronic signals communicate with one another. New electronic devices continue to be developed, which transmit the signals at ever increasing speed, and which devices simultaneously process increased numbers of simultaneously occurring signals. Accordingly, a trend that electrical connectors mounted in such devices need improved contact arrangement for transmitting high-frequency signals comes into being. U.S. Pat. No. 6,986,681 B2, discloses a conventional electrical connector which includes an insulative housing and a plurality of contacts retained in the insulative housing. The contacts include an upper contact row and a lower contact row wherein the signal contacts of the upper row are of different length of the signal contacts of the lower contact row. In this condition, there is a signal transmission delay between such signal contacts. Therefore, the high-frequency characteristic of the connector is considerably degraded and the cross talk increases.

Hence, it is desired to have an electrical connector solving the problem above.

BRIEF SUMMARY OF THE INVENTION

Accordingly, an object of the present invention is to provide an electrical connector that has excellent high-frequency characteristics and can provide balanced signal transmission and low cross talk.

In order to attain the objective above, an electrical connector has a first end for fitting with another connector and a second end for connecting to a board. The electrical connector comprises an insulative housing, a plurality of contacts retained in the insulative housing and a metal shield enclosing the housing. The insulative housing includes a tongue plate extending forwardly from a front wall thereof. The tongue plate defines a plurality of passageways along a first direction for receiving the contacts. The contacts are disposed in three parallel rows in the second end along the first direction. The contacts include signal contact pairs and a plurality of grounding contacts. The signal contact pairs are arranged parallel to one another. On opposite sides of each signal contact pair, the grounding contacts are disposed adjacent to and separate the signal contact pairs. Each signal contact pair includes a first signal contact and a second signal contact. The first and second signal contacts respectively include a first and a second contact portion for engaging with the another connector and respectively include a first and a second soldering portion connecting to the board. The grounding contact includes an engaging portion engaging with the another connector and a terminal portion connecting to the board. The first and second contact portions and the engaging portion are parallel and coplanar in the first end. The first and second soldering portions together with the terminal portions are parallel and spaced from one anther in the first direction and another direction perpendicular to the first direction. The first and the second signal contacts are of equal length and located near to each other so that the first and second signal contacts have matched impedance for transmitting high-speed signals and canceling any cross talk therebetween. As a result, a balanced signal transmitting occurs in the signal contacts.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Figure 1:
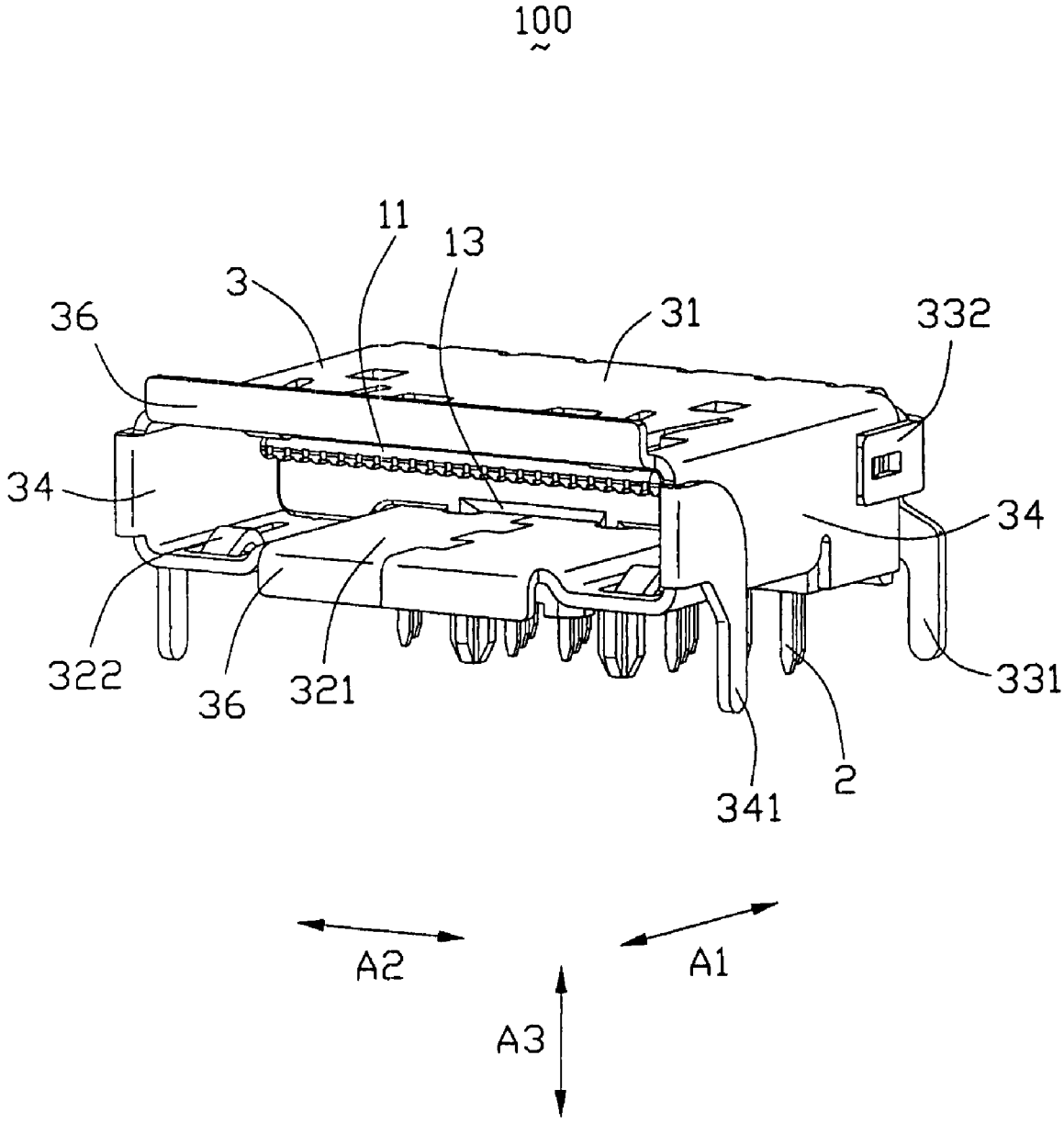
FIG. 1 is a perspective view of an electrical connector according to the present invention.
Figure 2:
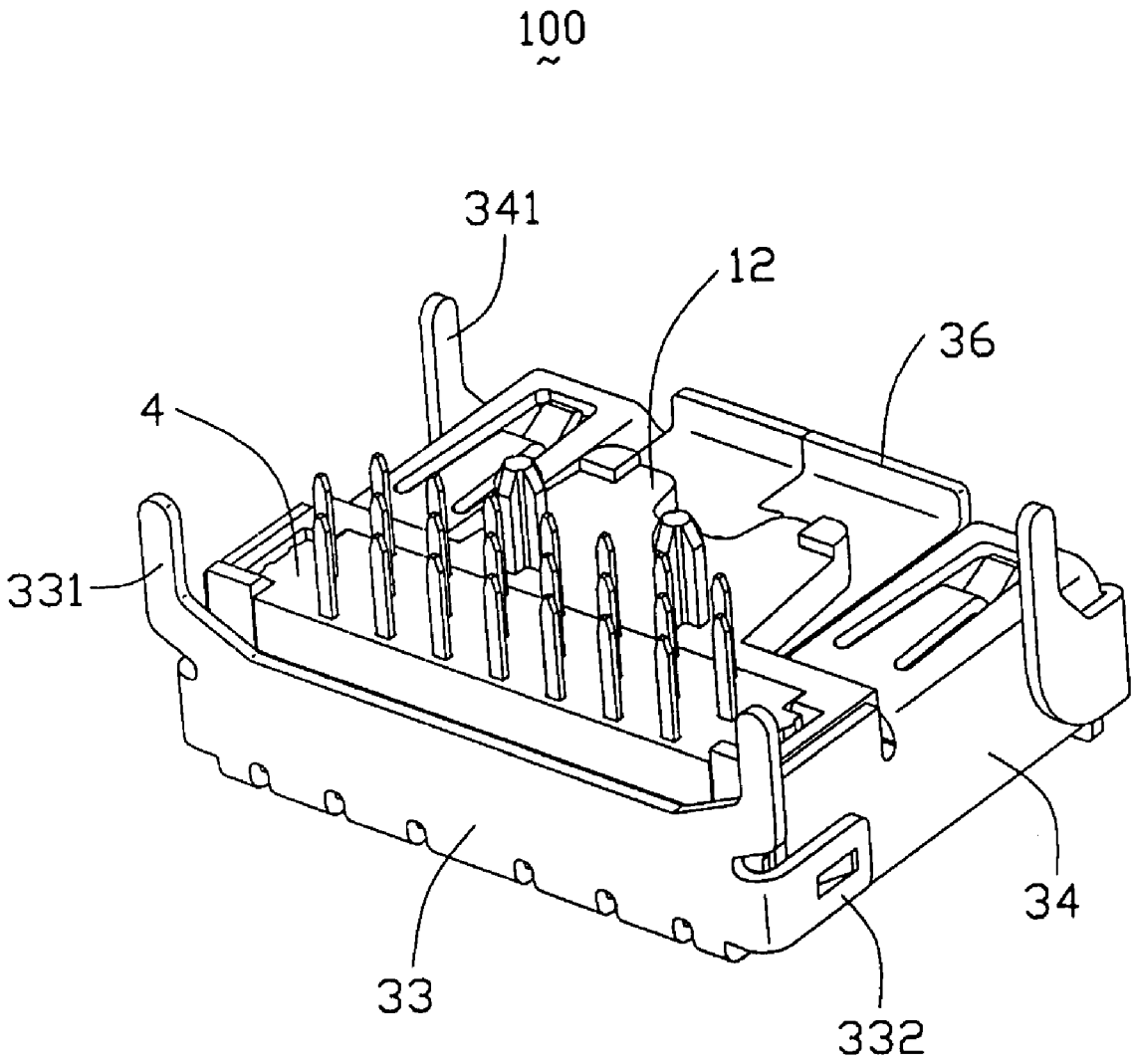
FIG. 2 is another perspective view of the electrical connector.
Figure 3:
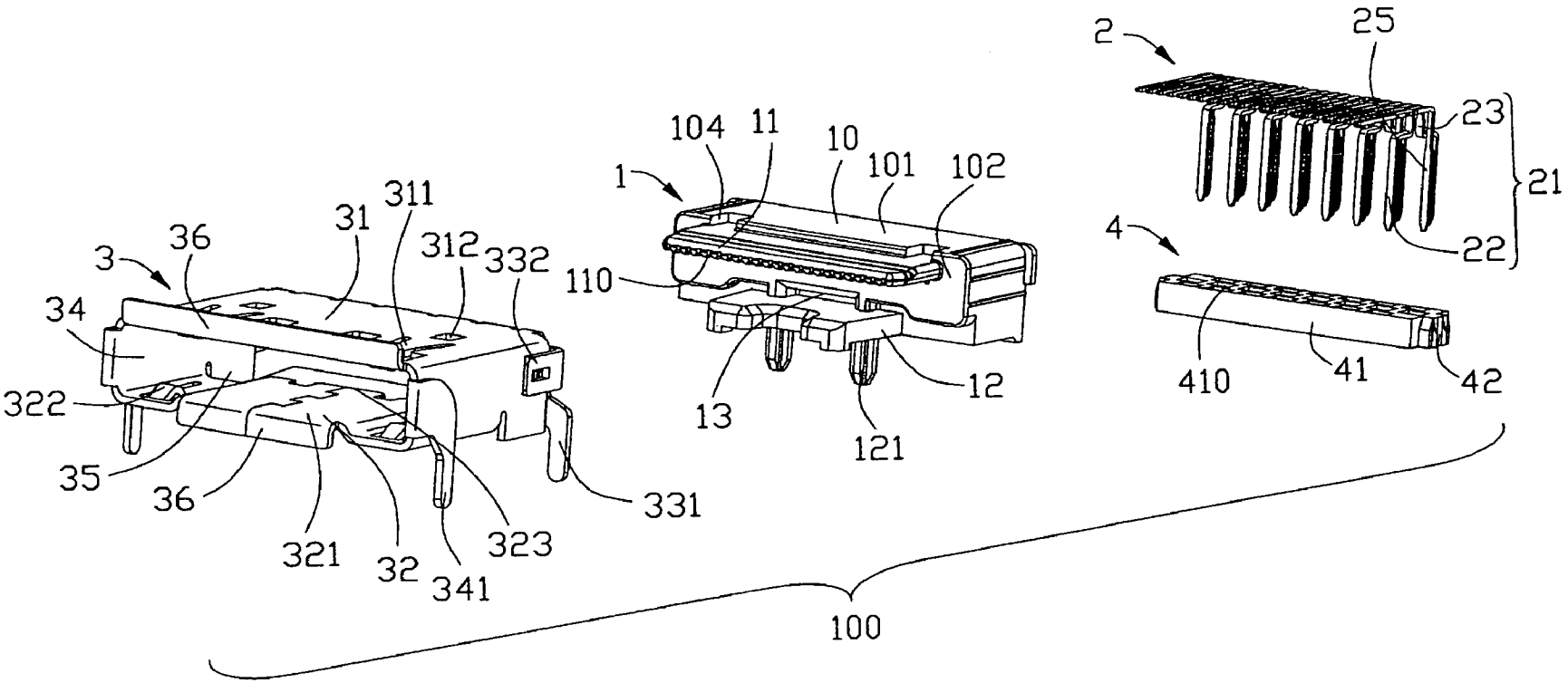
FIG. 3 is an exploded view of the electrical connector.
Figure 4:
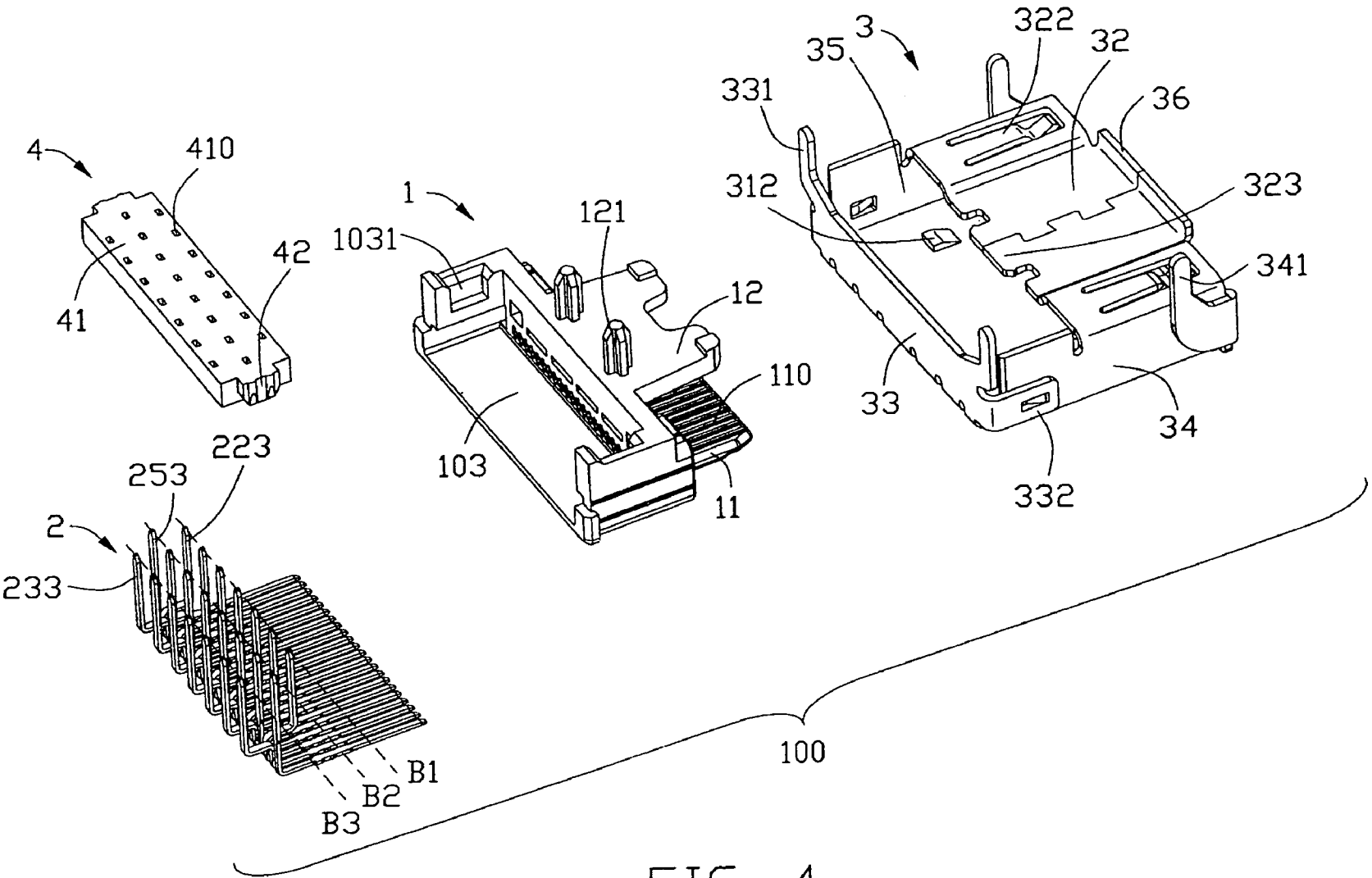
FIG. 4 is another exploded view of the electrical connector.

Reference will now be made in detail to the preferred embodiment of the present invention.

Referring to the drawings and in particular to FIGS. 1 to 5, an electrical connector 100 having a first end for fitting with a mating connector (not shown) and a second end for connecting to a printed circuit board (PCB, not shown). The electrical connector 100 is connected to the mating connector in a first direction A1 in order to transmit a balanced signal. The connector 100 is mounted on the PCB in a third direction A3 perpendicular to the first direction A1. A direction perpendicular to the first and third directions A1, A3 will be called a second direction A2.

The electrical connector 100 comprises an insulative housing 1, a plurality of contacts 2 retained in the insulative housing 1, a metal shield 3 enclosing the housing 1 and a spacer 4 for mating with the contacts 2.

The insulative housing 1 includes a base 10, a tongue plate 11 and a bottom plate 12. The base 10 includes a top wall 101, a front wall 102 and a chamber 103 disposed opposite to the front wall 102. The top wall 101 defines a pair of recesses 104 in communication of the tongue plate 11. The tongue plate 11 and the bottom plate 12 respectively extend forwardly from upper and lower portions of the front wall 102 wherein the upper surface of the tongue plate 11 is a little lower than the top wall 101. A plurality of horizontal passageways 110 are disposed in a lower surface of the tongue plate 11 for receiving the contacts 2 therein. The passageways 110 extend along the first direction A1. Further, the passageways 110 are in communication with the chamber 103 from which the contacts 2 are assembled. The chamber 103 has a couple of apertures 1031 on lateral sides thereof for mating with the spacer 4. The insulative housing 1 further defines an engaging slot 13 adjacent to the bottom plate 12 for engaging with the shield 3. The bottom plate 12 includes a pair of posts 121 extending downwardly therefrom wherein the posts 121 are received in the holes (not shown) defined in the PCB for positioning purpose.

Figure 5:
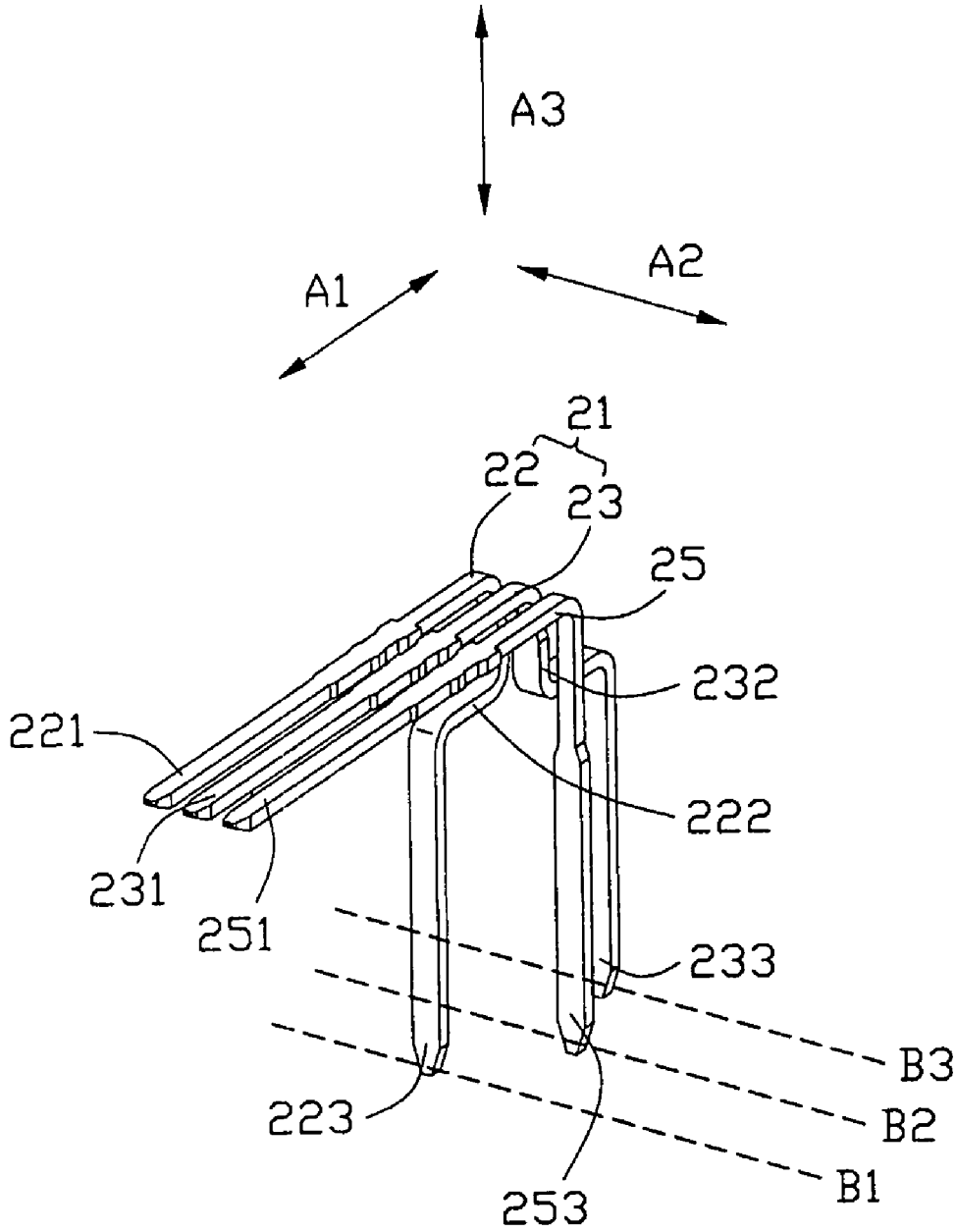
FIG. 5 is a partly view of a signal contact pair and a grounding contact.

Referring to FIG. 5, the contacts 2 are stamped from metal material and disposed side by side in the first end. The contacts 2 include signal contact pairs 21 and a plurality of grounding contacts 25. The signal contact pairs 21 are arranged in parallel to one another. On opposite sides of every signal contact pair 21, the grounding contacts 25 are disposed adjacent to and separated from the signal contact pair 21. In the following description, one of the signal contacts 21 in each pair will be called a first signal contact 22 and the other will be called a second signal contact 23. The grounding contact 25 is L-shaped and includes a horizontal engaging portion 251 and a terminal portion 253 perpendicular to the engaging portion 251. The first signal contact 22 includes a first contact portion 221, a first soldering portion 223 perpendicular to the first contact portion 221, and a first connecting portion 222 connecting the first contact portion 221 and the first soldering portion 223. The first contact and soldering portions 221, 223 are planar shaped. The second signal contact 23 includes a second contact portion 231, a second soldering portion 233, and a second connecting portion 232 connecting the second contact portion 231 and the second soldering portion 233. The first contact portion 221, the second contact portion 231 and the engaging portion 251 are in a same configuration. The first and second contact portions 221, 231 are coplanar with the engaging portion 251 in the first end. The first and second connecting portions 222, 232 are curving shaped. The second connecting and soldering portions 232, 233 are respectively symmetrical to the corresponding portions of the first signal contact 22. In detail, the second connecting portion 231 extending on the opposite direction of the first connecting portion 222. All the first soldering portions 223, the second soldering portions 233 and the terminal portions 253 are parallel to each other and are disposed in three parallel rows B1, B2 and B3 along the first direction A1. The first soldering portions 223 align the first row B1. The second soldering portions 233 align the second row B3 and the terminal portions 253 align the middle row B2. The first and the second soldering portions 223, 233 in each signal contact pair 21, as well as the terminal portions 253 are located alternately along the first direction A1 and the second direction A2. The first signal contact 22 and the second signal contact 23 are of equal length and located near to each other. On opposite sides of every signal contact pair 21, the grounding contacts 25 are disposed adjacent to and separate the signal contact pairs 21. The terminal portions 253 of the grounding contacts 25 are disposed between the first and second soldering portions 223, 233 (as shown in FIG. 5). The signal contacts 22, 23 have matched impedance for transmitting high-speed signals, thereby canceling any cross talk between the first and second signal contacts 22, 23.

The metal shield 3 is stamped from a metal sheet. The metal shield 3 includes a top face 31, a bottom face 32, a rear face 33, a pair of side faces 34 connecting the top and bottom faces 31, 32, and a receiving space 35 formed by the peripheral faces. The top face 31 has a pair of first fingers 311 and a couple of tubers 312 for mating with the recesses 104 of the housing 1. The bottom face 32 includes a middle projecting portion 321 and a pair of second fingers 322 on the lateral side thereof. The projecting portion 321 extends into the receiving space 35 and defines a tab 323 for mating with the engaging slot 13. The first and second fingers 311, 322 extend inwardly into the receiving space 35 for abutting against the mating connector. Each side face 34 includes a first retaining tail 341 integrally bending backwardly and downwardly from the front edge thereof. The rear face 33 includes a pair of second retaining tails 331 and a couple of fixing portion 332 for locking with the side faces 34. The first and second retaining tails 341, 331 are in the same length for fastening the connector 100 on the PCB. Further, the top face 31 and the projecting portion 321 respectively have a lip portion 36 for guiding the insertion of the mating connector.

The spacer 4 includes a body portion 41 and a pair of protrusions 42 extending on the lateral side of the body portion 41. The body portion 41 defines a plurality of holes 410 for the terminal portion 253 together with the first and second soldering portions 223, 233 extending therethrough to be mounted on the PCB. The spacer 4 is assembled to the insulative housing 1 with the protrusions 42 mating with the apertures 1031.

Figure 6:
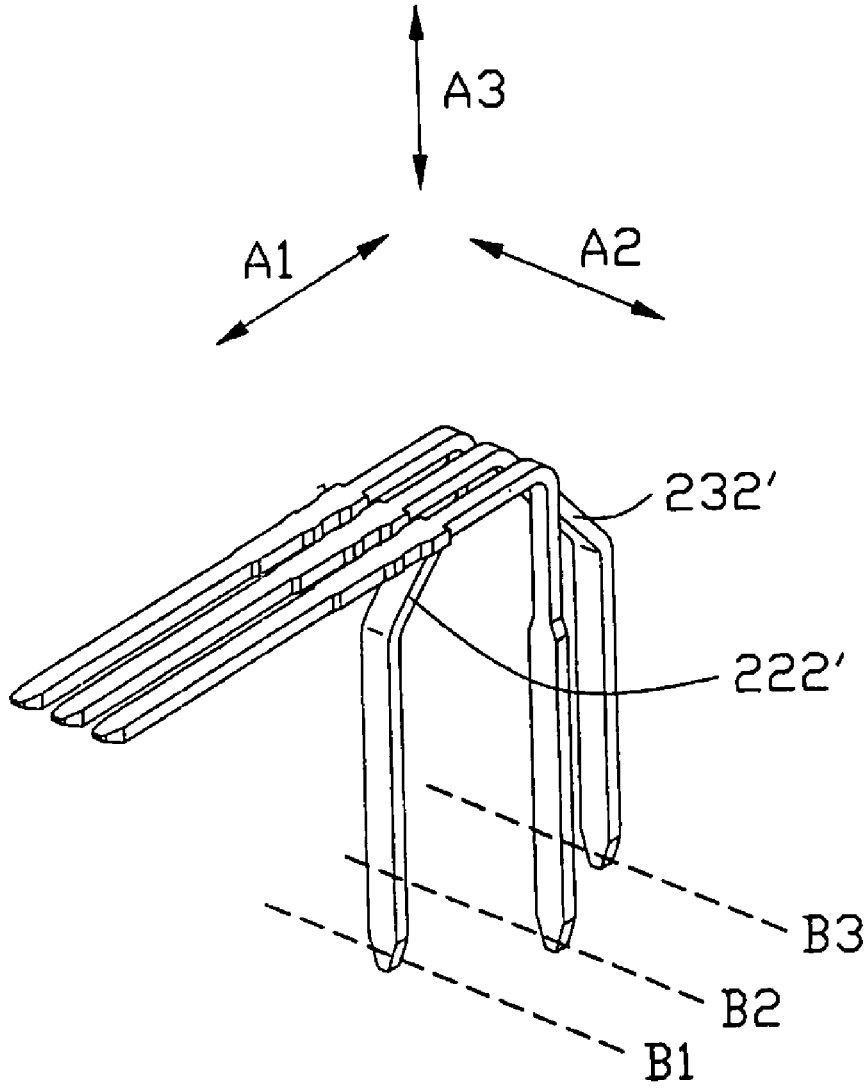
FIG. 6 is another partly view of a signal contact pair and a grounding contact of a second embodiment.

Please refer to FIG. 6, a second embodiment is provided of the contact arrangement. The differences between them are that the first connecting portion 221' and the second connecting portion 231' are slant shaped.

Figure 7:
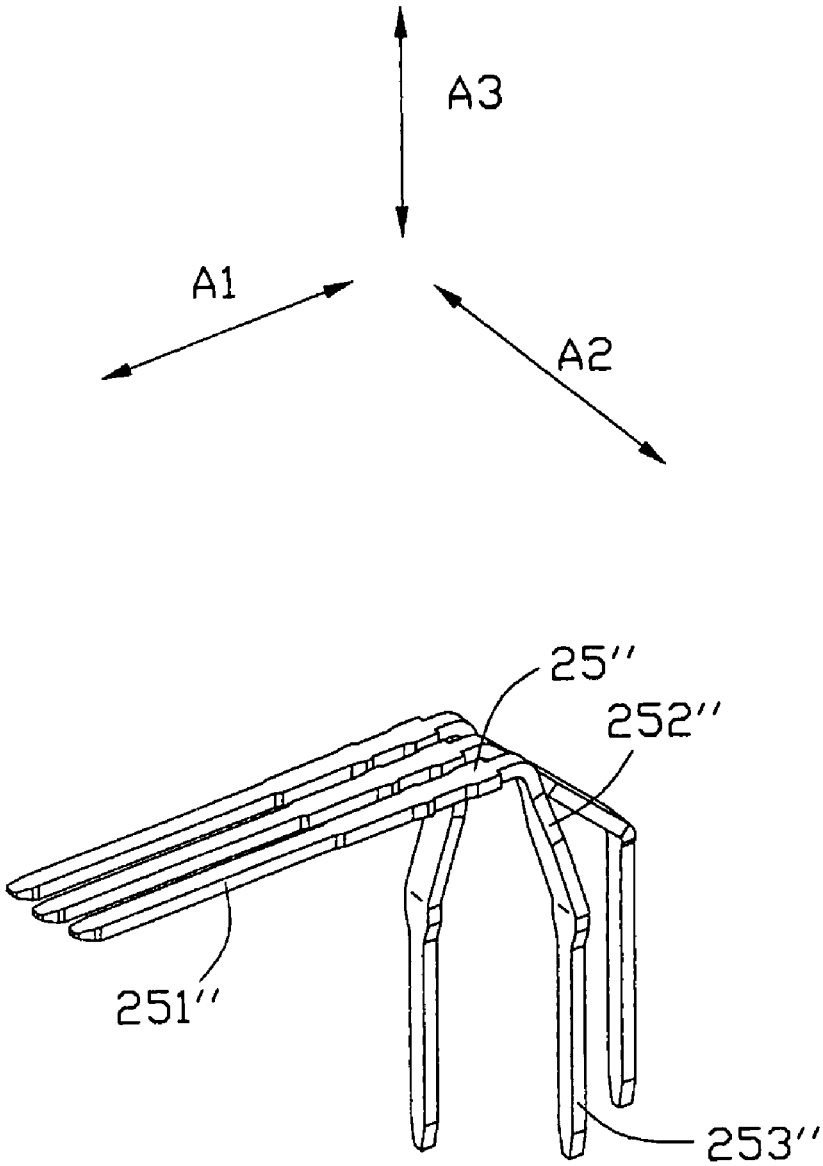
FIG. 7 is a third partly view of a signal contact pair and a grounding contact of a third embodiment.

Please refer to FIG. 7, a third embodiment is provided of the contact arrangement. The difference between the third embodiment and the second embodiment is that the grounding contact 25" further includes a slant intermediate portion 252" for connecting the engaging portion 251" and the terminal portion 253".

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector having a first end for fitting with another connector and a second end for connecting to a board, comprising:

an insulative housing defining a plurality of passageways along a first direction;

a plurality of contacts received in the passageways, said contacts including signal contact pairs and grounding contacts disposed adjacent to and separating the signal contact pairs, each signal contact pair having a first signal contact and a second signal contact being substantially in equal length of the first signal contact, the first and second contacts respectively having a first and a second contact portion for engaging with the another connector and respectively having a first and a second soldering portion for connecting to the board, the grounding contact including an engaging portion for engaging with the another connector and a terminal portion for connecting to the board, the first and second contact portions and the engaging portion being parallel and coplanar in the first end, the first and the second soldering portions being spaced from each other in the first direction.

2. The electrical connector according to claim 1, wherein the contacts are disposed in three parallel rows in the second end, the first soldering portions being on a first row, the second soldering portions being on a second row, and the terminal portions being on a middle row between the first and the second rows.

3. The electrical connector according to claim 1, wherein the first and the second contact portions and the engaging portion are coplanar in a horizontal plane.

4. The electrical connector according to claim 1, wherein the first and second soldering portions together with the terminal portion are parallel to a vertical direction.

5. The electrical connector according to claim 1, further comprising a spacer retained in the insulative housing and defining a plurality of holes for the contacts extending therethrough.

6. The electrical connector according to claim 1, wherein the first signal contact includes a first connecting portion connecting the first contact portion and the first soldering portion, the second signal including a second connecting portion connecting the second contact portion and the second soldering portion, wherein the first and the second connecting portions are essentially symmetrical to each other.

7. The electrical connector according to claim 6, wherein the first and the second connecting portions are curving shaped.

8. The electrical connector according to claim 6, wherein the first and the second connecting portions are slant shaped.

9. The electrical connector according to claim 1, wherein the insulative housing includes a base and a tongue plate extending from the base with the passageways defined therein.

10. The electrical connector according to claim 9, wherein the tongue plate includes a lower surface with the passageways defined therein.

11. The electrical connector according to claim 10, wherein the insulative housing includes a top wall, the tongue plate including an upper surface opposite to the lower surface, wherein the upper surface is lower than the top wall.

12. The electrical connector according to claim 9, further comprising a metal shield enclosing the insulative housing, the metal shield including a top face, a bottom face, a pair of side faces connecting the top and bottom faces, and a receiving space formed by the top and bottom faces and the side faces, the tongue plate extending into the receiving space.

13. The electrical connector according to claim 12, wherein the bottom face includes a middle projecting portion extending into the receiving space.

14. The electrical connector according to claim 12, wherein the top and bottom faces respectively include a pair of first and second fingers extending inwardly into the receiving space.

15. The electrical connector according to claim 12, wherein each side face includes a first retaining tail extending backwardly and downwardly from a front edge thereof, the retaining tail being retained to the board.

16. The electrical connector according to claim 12, wherein the metal shield includes a rear face for mating with the side faces, the rear face defining a pair of second retaining tails on lateral sides thereof.

17. An electrical connector comprising:

an insulative housing defining a mating port and a plurality of passageways communicated with the mating port;

a plurality of contacts disposed in the corresponding passageways, respectively; each of said contacts defining a mating portion for mating with a complementary connector, and a mounting portion for mounting to a printed circuit board;

the mating portions of all the contacts arranged in one common horizontal plane while the mounting portions of said contacts arranged in three vertical rows; wherein the contacts in a middle row of said three rows are grounding contacts while the contacts in two side rows of said three rows are signal contacts under a condition that the mounting portions in the middle row are shorter than those in the two sides rows which have a same length with each other.

18. The electrical connector as claimed in claim 17, wherein the mounting portions in the two side rows are arranged in a mirror image manner from a side view.

19. The electrical connector as claimed in claim 17, wherein the mounting portions in the middle row extend straightly while those in the two side rows extend in an zigzag manner and offset from those in the middle row.

20. The electrical connector as claimed in claim 17, wherein the mounting portion of the contacts in said three rows are alternately arranged with one another in sequence along a longitudinal direction of the housing.

* * * * *